United States Patent [19]

Hosoi

[11] Patent Number: 4,803,144

[45] Date of Patent: Feb. 7, 1989

[54] ELECTROPHOTOGRAPHIC ENCAPSULATED PRESSURE FIXABLE TONER PARTICLES WITH ELECTROCONDUCTIVE POWDER COATING

[75] Inventor: Noriyuki Hosoi, Shizuoka, Japan

[73] Assignee: Fuji Photo Film Co., Ltd., Kanagawa, Japan

[21] Appl. No.: 16,962

[22] Filed: Feb. 19, 1987

Related U.S. Application Data

[63] Continuation of Ser. No. 758,570, Jul. 24, 1985, abandoned, which is a continuation of Ser. No. 433,712, Oct. 12, 1982, abandoned.

[30] Foreign Application Priority Data

Oct. 16, 1981 [JP] Japan ..... 56-165265

[51] Int. Cl.[4] ..... G03G 9/14

[52] U.S. Cl. ..... 430/106.6; 430/111; 430/138; 430/903; 430/110

[58] Field of Search ..... 430/106.6, 111, 110, 430/138, 903

[56] References Cited

U.S. PATENT DOCUMENTS

| | | | |
|---|---|---|---|
| 3,234,017 | 2/1966 | Hegl et al. | 430/107 X |
| 3,607,342 | 9/1971 | Sato | 430/107 X |
| 3,672,928 | 6/1972 | Madrid et al. | 430/48 |
| 4,108,786 | 8/1978 | Takayama et al. | 430/106.6 X |

*Primary Examiner*—J. David Welsh

*Attorney, Agent, or Firm*—Jules E. Goldberg

[57] ABSTRACT

An electrostatographic toner material suitably employable for the pressure fixing process, which comprises encapsulated toner particles having an average particle size in the range from about 0.5 to 1,000 microns, in which the toner particle comprises a pressure fixable adhesive core material containing colorant and magnetizable substance and a pressure rupturable shell enclosing the core material, the outer surface of the shell being provided with white electroconductive powder.

9 Claims, No Drawings

ELECTROPHOTOGRAPHIC ENCAPSULATED PRESSURE FIXABLE TONER PARTICLES WITH ELECTROCONDUCTIVE POWDER COATING

This is a continuation of application Ser. No. 758,570 now abandoned filed July 24, 1985, which, in turn is a continuation of application Ser. No. 433,712, filed Oct. 12, 1982 now abandoned.

This invention relates to an electrostatographic toner material, and more particularly relates to a pressure fixable electrostatographic toner material comprising encapsulated toner particles.

There is known the electrostatography which comprises developing a tone electrostatic latent image contained on a photoconductive or dielectric surface with a toner material containing colorant and a fixing aid to produce a visible toner image, and transferring and fixing the visible toner image onto a surface of a support medium such as a sheet of paper.

The development of the latent image to produce a visible toner image is carried out by the use of either a developing agent consisting of a combination of toner material with carrier particles, or a developing agent consisting of toner material only. The developing process utilizing the combination of toner material with carrier particles is named "two component developing process", while the developing process utilizing only the toner material is named "one component developing process". The toner material employable in the one component developing process generally contains magnetizable substance.

The toner image formed on the latent image is then transferred onto a surface of a support medium and fixed thereto. The process for fixing the toner image to the support medium can be done through one of three fixing processes, that is, a heat fixing process (fusion process), a solvent fixing process and a pressure fixing process.

The pressure fixing process which involves fixing the toner material onto the surface of a support medium under application of pressure thereto is described, for instance, in U.S. Pat. No. 3,269,626. The pressure fixing process involving the use of neither the heating procedure nor the solvent produces no such troubles as inherently attached to either the heat fixing process or the solvent fixing process. Moreover, the pressure fixing process can be employed with a high speed automatic copying and duplicating process, and the access time is very short in the pressure fixing process. Accordingly, the pressure fixing process is said to be an advantageous fixing process inherently having a variety of preferably features.

However, the pressure fixing process also has a variety of inadvantageous features. For instance, the pressure fixing process generally provides poorer fixability than the heat fixing process does, whereby the toner image fixed onto a paper is apt to rub off easily. Further, the pressure fixing process requires very high pressure for the fixing, and such a high pressure tends to break the cellulose fibers of the support medium such as paper and also produces glossy surface on the support medium. Moreover, the pressing roller requires to have relatively greater size, because the roller necessarily imparts very high pressure to the toner image on the support medium. Accordingly, reduction of the size of a copying and duplicating machine cannot exceed a certain limit defined by the size of the pressing roller.

There has been previously proposed an encapsulated toner material which comprises toner particles enclosed with micro-capsules, so as to overcome the above-described disadvantageous features of the pressure fixing process. The encapsulated toner material is prepared by enclosing core particles (containing colorant such as carbon black) with shells which are rupturable by the application of pressure. The so-prepared encapsulated toner material has various advantageous features; for instance, the fixing of the encapsulated toner material does not require very high pressure, and the fixability is excellent. Accordingly, the encapsulated toner material is viewed as suitable for the use in the pressure fixing process. However, the encapsulated toner materials proposed up to now appear unsatisfactory in practical use, because they are not able to satisfy certain characteristics required for providing smooth copying and duplicating operation and for accomplishing excellent toner image fixability and quality.

More in detail, it is required for the toner material for the use as a dry type developing agent in the electrostatography to have excellent powder characteristics (or, powder flow properties) to provide high development quality, and to be free from staining the surface of the photosensitive material on which the latent image is formed. The term "powder characteristics" particularly means resistance to agglomeration and blocking of the toner particles. In the process for the preparation of an encapsulated toner material, the toner material is generally separated from a toner dispersed solution and dried through a spray-drying procedure. The previously known encapsulated toner material is apt to undergo agglomeration either in the spray-drying process, or in the storage period after the spray-drying. The so agglomerated toner material markedly degrades the resolution of the visible toner image produced on the electrostatographic latent image, whereby markedly decreasing the sharpness of the visible toner image fixed onto the support medium.

The toner material for the use as a developing agent in the pressure fixing process is further required to be satisfactory in the fixability under pressure and not to undergo off-setting against the roller surface, that is, phenomenon in which the toner adheres to the roller surface so as to stain it.

Furthermore, the toner material for the use as a developing agent specifically in the one component developing process is required to have other characteristics such as high electroconductivity at the outer surface of the particle and high magnetic susceptibility.

As for the toner material of the conventional nonencapsulated type, there is proposed in Japanese patent Provisional Publication No. 49(1974)-5035, a toner material for the one component developing process, which is prepared by mixing a thermoplastic organic polymer with a ferromagnetizable material; hardening the mixture; pulverizing the hardened mixture to prepare powdery particles; and then providing carbon powder onto the surface of the particles under heating, whereby the carbon powder can be set on the fused surface.

As for the toner material of the encapsulated type, there are proposed a certain number of toner materials for the one component developing process, as described below.

Japanese Patent Provisional Publication No. 51(1976)-81134 discloses an encapsulated toner material which encloses hydrophobic magnetizable substance within a hydrophilic film-forming polymer. However, this toner material is poor in the electroconductivity, because no processing for imparting electroconductivity is given onto the surface.

Japanese Patent Provisional Publication No. 51(1976)-8023 discloses a toner material encapsulated with a double layer, into the outer layer of the which is incorporated electroconductive substance. This toner material, however, is still insufficient in the electroconductivity, because an insulating material forming the outer layer covers most part of the surface of the toner.

Japanese Patent Provisional Publication No. 52(1977)112325 discloses a toner material comprising core material containing magnetizable substance and a shell enclosing the core material, whose shell contains electroconductive substance therein. This toner material, however, likewise insufficient in the electroconductivity, because of the same reasons described above.

The encapsulated toner materials proposed until now are not satisfactory, at least, in one of the requirements for the developing agent to be employed for the pressure fixing process.

It is, accordingly, an object of the invention to provide an electrostatographic toner material free from the drawbacks described above.

It is another object of the invention to provide an encapsulated toner material suitably employed for the pressure fixing process based on the one component developing process, and free from the drawbacks described above.

It is a further object of the invention to provide an encapsulated toner material suitably employed for the pressure fixing process, whose powder characteristics are remarkably improved.

It is a still further object of the invention to provide an encapsulated toner material having improved pressure fixability in addition to the improved powder characteristics.

It is a still further object of the invention to provide an encapsulated toner material having improved resistance to the off-setting in addition to the improved powder characteristics and the improved pressure fixability.

It is a still further object of the invention to provide an encapsulated toner material which is resistant to rupture prior to the pressing operation in the pressure fixing process, while which is readily rupturable in the pressure fixing operation.

The above-described objects and other objects which will be apparent from the hereinafter-given description are accomplished by the present invention, that is, an electrostatographic toner material comprising encapsulated toner particles having an average particle size in the range from about 0.5 to about 1,000 microns, in which the toner particle comprises a pressure fixable adhesive core material containing colorant and magnetizable substance and a pressure rupturable shell enclosing the core material, the outer surface of the shell being provided with white electroconductive powder.

In the invention, the white electroconductive powder preferably is a metal oxide powder, such as an oxide of metal selected from the group consisting of zinc, titanium, tin, aluminum, indium, silicon, magnesium, barium, molybdenum, and a combination of two or more of said metals. Preferred metal oxides are ZnO, $TiO_2$, $SnO_2$, $Al_2O_3$, $In_2O_3$, $SiO_2$, MgO, BaO, and $MoO_3$. Most preferred are ZnO, $TiO_2$ amd $SnO_2$.

The white metal oxide powder is preferably doped with a small amount of a different atom serving as a donor in the metal oxide powder in which the atom is doped. Examples of the doped metal oxides include zinc oxide (ZnO) doped with aluminum or indium; titanium dioxide ($TiO_2$) doped with niobium or tantalum; and stannic oxide ($SnO_2$) doped with antimony, niobium or halogen. The donner atom is preferably doped into the metal oxide in the amount of 0.01–30 molar %, more preferably 0.1–10 molar %. Oxygen defective metal oxides are also preferred.

In the invention, the white electroconductive powder is preferably in the form of fine particles having diameter not more than 2 microns, more preferably not more than 0.5 micron. The volume resistance of the powder is preferably not higher than $10^7$ ohme-cm, and more preferably not higher than $10^3$ ohme-cm.

The white electroconductive powder of the invention can be provided onto an outer surface of shell of an encapsulated toner material, for instance, by introducing powdery electroconductive powder into a suspension of the encapsulated toner particles, mixing the suspension and spray-drying a suspension containing the encapsulated toner particles and the electroconductive powder. A surface active agent can be introduced into a suspension of the encapsulated toner particles or a suspension containing the toner particles and the electroconductive powder so as to prepare a satisfactory dispersion.

The white electroconductive powder is provided onto the surface of the encapsulated toner material preferably in the amount of 0.1–10 % by weight of the toner material.

There is no specific limitation on the material of shell of the encapsulated toner according to the invention, as far as the material is pertinent to the production of the shell. Examples of the shell materials include gum arabic, gelatin, polyester, polyamide, polystyrene, polycarbonate, polyether, polyethylene, polyurea, polyurethane, polythiourethane, polythiourea, amino resin, and copolymers such as poly(styrene-methacrylate) and poly(styrene-acrylate). Preferred are polyurethane, polyurea and amino resin.

The shell can be composed substantially of a complex layer. For instance, the shell can comprise two or more polymers selected from the group consisting of polyurethane, polyurea and polyamide.

In the present invention, the term "polyurethane and/or polyurea" means polymers produced by the polycondensation reaction between polyisocyanate and one or more of the counterpart compounds such as polyol, polythiol, water, polyamine and piperazine. Accordingly, the term "polyurethane" means either a simple polyurethane comprising substantially the urethane bondings only or a polymer comprising the urethane bondings and a relatively small number of the urea bonding. The term "polyurea" means either a simple polyurea comprising substantially the urea bondings only or a polymer comprising the urea bondings and a relatively small number of the urethane bonding.

The term "amino resin" means a polymer containing in the molecular structure a relatively great number of nitrogen atoms in the form of the amino group ($-NH_2$). Examples of the amino resins include melamine-formaldehyde resin, urea-formaldehyde resin, and metamine-ureaformaldehyde resin.

The material preferably employed for preparing the shell in the invention is a polycondensation product of polyisocyanate, polyol and water, or a polycondensation product of polyisocyanate, polyol and polyamine. The amino resin is also preferred.

The electrostatographic toner material of the invention is preferably prepared by a process which comprises encapsulating very small droplets of the pressure fixable adhesive core material containing colorant and magnetizable substance dispersed in an aqueous medium with the pressure rupturable shell material to prepare encapsulated particles, providing the surfaces of the encapsulated particles with the white electroconductive powder and separating the encapsulated particles from the aqueous medium to obtain dry encapsulated toner materials.

The encapsulation of the droplets of the core material with the shell material can be done by any known method for preparing the so-called micro-capsule containing a hydrophobic liquid, such as the phase separation method as described in U.S. Pat. Nos. 2,800,457 and 2,800,458; the interfacial polymerization as described in Japanese Patent Publications Nos. 38(1963)-19,574, 42(1967)-446 and 42(1967)-771, British Pat. Nos. 989,264, 950,443, 867,797, 1,069,140 and 1,046,409; the method involving polymerization of a monomer in oil droplets as described in Japanese Patent Publication No. 36(1961)-9,168; the method involving melting, dispersing and cooling procedures as described in British Pat. Nos. 952,807 and 965,074; and the spray drying method as described in U.S. Pat. No. 3,111,407 and British Pat. No. 930,422.

Among these encapsulating method, the interfacial polymerization method comprising the following process is preferably employed for the preparation of the toner material of the invention.

In the first place, the following two substances are selected.

Substance (A) which as such is a hydrophobic liquid or a substance soluble, miscible or well dispersable in a hydrophobic liquid; and Substance (B) which as such is a hydrophilic liquid or a substance soluble, miscible or well dispersable in a hydrophilic liquid, in which Substance (A) can react with Substance (B) to produce polyurethane, polyurea or polythiourethane insoluble in either the hydrophobic liquid or the hydrophilic liquid.

In the second place, very small droplets of a hydrophobic liquid including Substance (A) and the core material containing colorant and magnetizable substance and having an average diameter in the range from about 0.5 to about 1,000 microns are dispersed in a hydrophilic liquid such as water containing Substance (B).

A catalyst can be incorporated in either or both of the hydrophobic liquid and the hydrophilic liquid.

The Substance (A) is caused to react with Substance (B) to undergo interfacial polymerization in the dispersion by an appropriate procedure, for instance, by heating the dispersion. Thus, the shells of polyurethane or polyurea are formed around the hydrophobic droplets including the core material and the colorant, and accordingly the encapsulation of the core material and the colorant with the shell is accomplished to produce encapsulated toner particles in the aqueous liquid.

Examples of Substance (A) preferably employed for the preparation of the shell in the invention include compounds carrying isocyanate groups described below:

(1) Diisocyanate m-phenylenediisocyanate, p-phenylenediisocyanate, 2,6-tolylenediisocyanate, 2,4-tolylenediisocyanate, naphthalene-1,4-diisocyanate, diphenylmethane-4,4'-diisocyanate, 3,3'-dimethoxy-4,4'-biphenyldiisocyanate, 3,3'-dimethyldiphenylmethane-4,4'-diisocyanate, xylylene-1,4-diisocyanate, xylylene-1,3-diisocyanate, 4,4'-diphenylpropanediisocyanate, trimethylenediisocyanate, hexamethylenediisocyanate, propylene-1,2-diisocyanate, butylene-1,2-diisocyanate, ethylidynediisocyanate, cyclohexylene-1,2-diisocyanate, cyclohexylene-1,4-diisocyanate, p-phenylenediisocyanate, triphenylmethane- diisocyanate;

(2) Triisocyanate 4,4',4''-triphenylmethanetriisocyanate, polymethylenepolyphenyltriisocyanate, toluene-2,4,6-triisocyanate;

(3) Tetraisocyanate 4,4'-dimethyldiphenylmethane-2,2',5,5'-tetraisocyanate; and (4) Polyisocyanate prepolymer an addition product of hexamethylene diisocyanate and hexanetriol, an addition product of 2,4-tolylenediisocyanate and catechol, an addition product of 2,4-tolylenediisocyanate and hexanetriol, an addition product of 2,4-tolylenediisocyanate and trimethylolpropane, an addition product of xylylenediisocyanate and trimethyl- olpropane.

Examples of the Substance (B) preferably employed for the preparation of the shell in the invention include compounds described below:

(1) Water;

(2) Polyol and polythiol; ethylene glycol, 1,4-butanediol, catechol, resorcinol, hydroquinone, 1,2-dihydroxy-4-methylbenzene, 1,3-dihydroxy-5-methylbenzene, 3,4-dihydroxy-1-methylbenzene, 3,5-dihydroxy-1-methylbenzene, 2,4-dihydroxy-1-ethylbenzene, 1,3-naphthalenediol, 1,5-naphthalenediol, 2,3-naphthalenediol, 2,7-naphthalenediol, o,o'-biphenol, p,p'-biphenol, 1,1'-bi-2-naphthol, bisphenol A, 2,2'-bis(4-hydroxyphenyl)butane, 2,2'-bis(4-hydroxyphenyl)isopentane, 1,1'-bis(4-hydroxyphenyl)-cyclopentane, 1,1'-bis(4-hydroxyphenyl)-cyclohexane, 2,2'-bis(4-hydroxy-3-methylphenyl)-propane, bis(2-hydroxyphenyl)methane, xylylenediol, ethyleneglycol, 1,3-propylene glycol, 1,4-butylene glycol, 1,5-pentanediol, 1,6-heptanediol, 1,7-heptanediol, 1,8-octanediol, trimethylolpropane, hexanetriol, pentaerythritol, glycerol, sorbitol;

(3) Polyamine ethylenediamine, tetramethylenediamine, pentamethylenediamine, hexamethylenediamine, p-phenylenediamine, m-phenylenediamine, 2-hydroxytrimethylenediamine, diethylenetriamine, triethylenetetraamine, diethylaminopropylamine, tetraethylenepentaamine, an addition product of an epoxy compound and an amine compound; and (4) Piperazine piperazine, 2-methylpiperazine, 2,5-dimethylpiperazine.

In the preparation of the dispersion of the very small hydrophobic droplets containing Substance (A) and the core material, the hydrophobic liquid to be dispersed preferably contains a low-boiling solvent or a polar solvent. These solvents serve for accelerating formation of the shell which is a reaction product between the Substance (A) and the Substance (B). Examples of these solvents include methyl alcohol, ethyl alcohol, diethyl ether, tetrahydrofuran, dioxane, methyl acetate, ethyl acetate, acetone, methyl ethyl ketone, methyl isobutyl ketone, cyclohexanone, n-pentane, n-hexane, benzene, petroleum ether, chloroform, carbon tetrachloride, methylene chloride, ethylene chloride, carbon disulfide and dimethylformamide.

The encapsulated toner material whose shell is composed substantially of a complex layer comprising two or more polymers selected from the group consisting of polyurethane, polyurea and polyamide can be produced as follows:

In a hydrophobic liquid comprising core materials such as colorant, pressure fixable adhesive material (binder), and magnetizable substance, are dissolved an acid chloride and a polyisocyanate. This solution is then dispersed in an aqueous medium comprising a polyamine or piperazine and a dispersing agent to produce fine droplets of the core material having an average diameter in the range from about 0.5 to about 1,000 microns in the aqueous medium.

The dispersion produced above is then neutralized or made weak-alkaline by addition of an alkaline substance, and subsequently heated to a temperature between 40° and 90° C. Upon completion of this procedure, a complex layer consisting substantially of a polyamide and a polyurethane, in which the polyamide is a reaction product produced by reaction between the acid chloride and the polyamine, and the polyurea is a reaction product produced by reaction between the polyisocyanate and the polyamine, is formed around the droplet of core material containing a binder, a colorant and a magnetizable substance. Thus, the encapsulated particle having the complex layer shell is obtained.

If a polyol is further added to the hydrophobic liquid in the above, there is produced around the hydrophobic core material droplet a complex layer shell consisting substantially of the polyamide and a polyurethane, in which the polyurethane is a reaction product of the polyisocyanate with the polyol.

In the latter procedure, a complex layer consisting substantially of the polyamide, polyurea and polyurethane can be produced, if the polyamine is introduced into the reaction system in an amount exceeding the amount required to react the introduced acid chloride.

The shell of the so produced particle is, as described above, a complex layer shell. The term "complex layer shell" means a shell comprising a polymer mixture, as well as a double layer shell. The term "double layer shell" is not intended to mean only a shell in which the two layers are completely separated by a simple interface, but include a shell in which the interface is not clearly present in the shell, but the ratio between one polymer and another polymer (or other polymers) varies from the inner phase to the outer phase of the shell.

Examples of acid chlorides include adipoyl chloride, sebacoyl chloride, phthaloyl chloride, isophthaloyl chloride, terephthaloyl chloride, fumaroyl chloride, 1,4-cyclohexanedicarbonyl chloride, 4,4'-biphenyldicarbonyl chloride, 4,4'-sulfonyldibenzoyl chloride, phosgene, polyesters containing acid chloride groups, and polyamides containing acid chloride groups.

The acid chloride can be replaced with a dicarboxylic acid or its acid anhydride. Examples of the dicarboxylic acids include adipic acid, sebacic acid, phthalic acid, terephthalic acid, fumaric acid, 1,4-cyclohexanedicarboxylic acid and 4,4'-biphenyldicarboxylic acid. Examples of the acid anhydrides include phthalic anhydride.

As for the other aspects of the interfacial polymerization method and the other processes for the preparation of micro-capsules containing an oily liquid, there are given descriptions in U.S. Pat. No. 2,726,804, which is introduced hereinto as the reference.

The core material of the invention contains colorant for producing a visible image from the latent image. The colorant generally is a dye or a pigment, but a certain agent providing no directly visible image such as a fluorescent substance can be employed as the colorant, if desired.

The colorant is generally selected from a variety of the dye, pigment and the like employed generally in the conventional electrostatographic copying and duplicating process. Generally the colorant is a black toner or a chromatic toner. Examples of the black toners include carbon black. Examples of the chromatic toners include blue colorants such as copper phthalocyanine and a sulfonamide derivative dye; yellow colorants such as a benzidine derivative colorant, that is generally called Diazo Yellow; and red colorants such as Rhodamine B Lake that is a double salt of xanthin dye with phosphorus wolframate and molybdate, Carmine 6B belonging to Azo pigment, and a quinacridone derivative.

The core material of the invention further contains a binder (adhesive material) for keeping the colorant within the core and assisting the fixing of the colorant onto the surface of a support medium such as paper. The binder is generally selected from high-boiling liquids conventionally employed or proposed for employment for finely dispersing an oil-soluble photographic additive within an aqueous medium to incorporate the additive into a silver halide color photosensitive material, and/or selected from polymers proposed for employment as the binders for the pressure fixable encapsulated toner materials.

Examples of the high-boiling liquids include the following compound having the boiling point of higher than 180° C.:

(1) Phthalic esters dibutyl phthalate, dihexyl phthalate, diheptyl phthalate, dioctyl phthalate, dinonyl phthalate, dodecyl phthalate, butyl phthalyl butyl glycolate, dibutyl monofluorophthalate;

(2) Phosphoric acid esters tricresyl phosphate, trixylenyl phosphate, tris(isopropylphenyl) phosphate, tributyl phosphate, trihexyl phosphate, trioctyl phosphate, trinonyl phosphate, tridecyl phosphate, trioleyl phosphate, tris(butoxyethyl) phosphate, tris(chloroethyl) phosphate, tris(dichloropropyl) phosphate;

(3) Citric acid esters

O-acetyl triethyl citrate, O-acetyl tributyl citrate, O-acetyl trihexyl citrate, O-acetyl trioctyl citrate, O-acetyl trinonyl citrate, O-acetyl tridecyl citrate, triethyl citrate, tributyl citrate, trihexyl citrate, trioctyl citrate, trinonyl citrate, tridecyl citrate;

(4) Benzoic acid esters butyl benzoate, hexyl benzoate, heptyl benzoate, octyl benzoate, nonyl benzoate, decyl benzoate, dodecyl benzoate, tridecyl benzoate, tetradecyl benzoate, hexadecyl benzoate, octadecyl benzoate, oleyl benzoate, pentyl o-methylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methoxybenzoate;

(5) Aliphatic acid esters hexadecyl myristate, dibutoxyethyl succinate, dioctyl adipate, dioctyl azelate, decamethylene-1,10-diol diacetate, triacetin, tributin, benzyl caprate, pentaerythritol tetracaproate, isosorbitol dicaprilate;

(6) Alkylnaphthalenes methylnaphthalene, dimethylnaphthalene, trimethylnaphthalene, tetramethylnaphthalene, ethylnaphthalene, diethylnaphthalene, triethylnaphthalene, monoisopropylnaphthalene, diisopropylnaphthalene, tetraisopropylnaphthalene, monomethylethylnaphthalene, isooctyl- naphthalene;

(7) Dialkylphenyl ethers di-o-methylphenyl ether, di-m-methyldiphenyl ether, di-p-methylphenyl ether;

(8) Amides of fatty acids and aromatic sulfonic acid

N,N-dimethyllauroamide, N,N-diethylcaprylamide, N-butylbenzenesulfonamide;

(9) Trimellitic acid esters trioctyl trimellitate;

(10) Diarylalkanes diarylmethanes, e.g., dimethylphenylphenylmethane, diarylethanes, e.g., 1-methylphenyl-1-phenylethane, 1-dimethylphenyl-1-phenylethane, 1-ethylphenyl-1-phenylethane.

The above-listed high-boiling liquids and examples of other high-boiling liquids employable in the invention are described in detail in the following publications:

Japanese Patent Publications Nos. 46(1971)-23,233 and 49(1974)-29,461; Japanese Patent Provisional Publications Nos. 47(1972)-1,031, 50(1975)-62,632, 50(1975)-82,078, 51(1976)-26,035, 51(1976)-26,036, 51(1976)-26,037, 51(1976)-27,921, and 51(1976)-27,922; U.S. Pat. Nos. 2,322,027, 2,353,262, 2,533,514, 2,835,579, 2,852,383, 3,287,134, 3,554,755, 3,676,137, 3,676,142, 3,700,454, 3,748,141, 3,837,863, and 3,936,303; British Pat. Nos. 958,441, 1,222,753, 1,346,364, and No. 1,389,674; and West Germany Offenlegungsschrift No. 2,538,889.

For the purpose of the invention, the high-boiling liquid is preferably selected from the phthalic acid esters, phosphoric acid esters and alkylnaphthalenes.

Examples of the polymers include the following polymers:

polyolefins, olefin copolymers, polystyrene, styrenebutadiene copolymer, epoxy resins, polyesters, natural and synthetic rubbers, polyvinylpirolidone, polyamides, cumarone-indene copolymer, methyl vinyl ether-maleic anhydride copolymer, maleic acid-modified phenol resin, phenol-modified terpene resin, silicone resins, epoxy-modified phenol resin, amino resins, polyurethane elastomers, polyurea elastomers, homopolymers and copolymers of acrylic acid ester, homopolymers and copolymers of methacrylic acid ester, acrylic acid-long chain alkyl methacrylate copolymer oligomer, poly(vinyl acetate), and poly(vinyl chloride).

The above-listed polymers and examples of other polymers employable in the invention are described in detail in the following publications:

Japanese Patent Publications Nos. 48(1973)-30,499, 49(1974)-1,588 and 54(1979)-8,104; Japanese Patent Provisional Publications Nos. 48(1973)-75,032, 48(1973)-78,931, 49(1974)-17,739, 51(1976)-132,838, 52(1977)-98,531, 52(1977)-108,134, 52(1977)-119,937, 53(1978)-1,028, 53(1978)-36,243, 53(1978)-118,049, 55(1980)-89,854 and 55(1980)-166,655; and U.S. Pat. Nos. 3,788,994 and 3,893,933.

The core material of the invention further contains magnetizable substance, preferably in the form of fine particles.

As for the magnetizable substances, there are given descriptions, for instance, in Japanese Patent Provisional Publications Nos. 53(1978)-118,053, 53(1978)-1,028 and 55(1980)-166,655. Examples of materials of the magnetizable substances preferably employed in the invention include metals such as cobalt, iron and nickel; metal alloys or metal compositions comprising aluminum, cobalt, copper, iron, lead, magnesium, nickel, tin, zinc, gold, silver, antimony, beryllium, bismuth, cadmium, calcium manganese, titanium, tungsten, vanadium and/or zirconium; metallic compounds including metal oxides such as aluminium oxide, ferric oxide, cupric oxide, nickel oxide, zinc oxide, zirconium oxide, titanium oxide and magnesium oxide; refractory metal nitrides such as chromium nitride; metal carbides such as tungsten carbide and silica carbide; ferro-magnetic ferrite; and their mixtures.

The releasing agent can be further contained in the core material for keeping the ruptured shell and the released core material from adhering to the surface of the pressing roller. The releasing agent can be chosen from those proposed for employment in the previously reported encapsulated toners. Examples of the releasing agents include a fluorine-containing resin described in Japanese Patent Provisional Publications Nos. 55(1980)-142,360 and 55(1980)-142,362.

As mentioned hereinbefore, a process for the preparation of the encapsulated toner particles includes a stage for dispersing or emulsifying very small droplets of the hydrophobic liquid containing Substance (A) and the core material in the aqueous medium. For the preparation of the homogeneous dispersion (or, emulsion) of the very small droplets of the hydrophobic liquid, it is preferred to incorporate into the reaction liquid a hydrophilic protective colloid and/or an emulsifying surface active agent which assist the production of the homogeneous dispersion (or, emulsion) of the hydrophobic droplets and prevention of agglomeration of the so-produced hydrophobic droplets. The hydrophilic protective colloid and the surface active agent can be employed alone or in combination.

Examples of the preferred hydrophilic protective colloids include proteins such as gelatin, graft polymers of gelatin and other polymers, albumin, and casein; cellulose derivatives such as hydroxyethylcellulose, carboxymethylcellulose, and cellulose sulfuric acid ester; saccharide derivatives such as sodium alginate and starch derivatives; and a variety of synthetic hydrophilic homopolymers and copolymers such as polyvinyl alcohol, partially acetalized polyvinyl alcohol, poly-N-vinyl pyrolidone, polyacrylic acid, polyacrylic amide, polyvinylimidazole and polyvinylpyrazole.

In the above-listed examples, the gelatin can be a lime-treated gelatin, an acid-treated gelatin, a hydrolyzed gelatin, and an enzymically decomposed gelatin. The graft polymers of gelatin and other polymers can be gelatins carrying graft chains consisting of homopolymers or copolymers of vinyl monomers such as acrylic acid, methacrylic acid, their derivatives, e.g., esters and amides, acrylonitrile, and styrene. Examples of the gelatin graft polymers are those miscible with gelatin such as the gelatins carrying the graft chains consisting of polymers of acrylic acid, methacrylic acid, acrylamide, methacrylamide and hydroxyalkyl methacrylate. acrylate.

Details of these preferred gelatin graft polymers are described in U.S. Pat. Nos. 2,763,625, 2,831,767, and 2,956,884.

Representative examples of the synthetic hydrophilic polymers are described, for instance, in West German Offenlegungsschrift No. 2,312,708, U.S. Pat. Nos.

3,620,751 and 3,879,205, and Japanese Patent Publication No. 43(1968)-7,561.

The surface active agents for dispersing or emulsifying the hydrophobic liquid in the hydrophilic liquid medium can be incorporated into either or both of the hydrophobic liquid and the hydrophilic liquid medium.

Examples of the surface active agents include nonionic surface active agents, for instance, saponin (steroide type), alkylene oxide derivatives such as polyethylene glycol, polyethylene glycol/polypropylene glycol condensation product, alkyl- or alkylarylether of polyethylene glycol, polyethylene glycol esters, polyethylene glycol sorbitol ester, alkylamine or amide of polyalkylene glycol, polyethylene oxide adduct of silicone polymer, glycidol derivatives such as polyglyceride alkenylsuccinate and alkylphenol polyglyceride, fatty acid esters of polyhydric alcohols, alkylesters of saccharide, urethanes and ethers; and anionic surface active agents having acidic groups such as carboxy, sulfo, phospho, sulfate ester and phosphate ester groups, for instance, triterpenoide-type saponin, alkylcarboxylic acid salts, alkylsulfonic acid salts, alkylbenzenesulfonic acid salt, alkylnaphthalenesulfonic salts, alkylsulfate esters, alkylphosphate esters, N-acyl-N-alkyl-taurines, sulfosuccinic acid esters, sulfoalkyl-polyoxyethylene alkyl phenyl ethers, and polyoxyethylene alkylphosphate esters.

Particularly preferred surface active agents are anionic surface active agents belonging to the sulfonic acid type and the sulfate ester type, namely, compounds having in the molecular structure both of hydrophobic groups containing 8–30 carbon atoms and hydrophilic groups of $-SO_3M$ or $-OSO_3M$ (in which M is Na or K). These preferred anionic surface active agents belonging to the above-mentioned types are described in detail in "Surface Active Agents" (A. W. Perry; Interscience Publication Inc., New York).

Representative examples of the preferred anionic surface active agents are as follows: sodium dodecylsulfate, sodium tetradecylsulfate, Turkey red oil, sodium dodecylcarboxyamidoethylsulfate, sodium dodecylsulfonate, sodium tetradecylsulfonate, sodium polyoxyethylene-octylphenyl-ethersulfonate, sodium salt of sulfosuccinic acid dioctylester, sodium dodecylbenzene sulfonate, sodium tetradecylamidophenylsulfonate, and sodium tri-isopropylnaphthalenesulfonate.

Dispersing or emulsifying the reaction liquid can be carried out by means of a known homogenizer such as one belonging to the stirring type, the high pressure injecting type, the ultrasonic vibrating type and the kneader type. Particularly preferred homogenizers are a colloid mill, a conventional homogenizer, and electromagnetic distortion inducing ultrasonic homogenizer.

The encapsulated toner is then produced, for instance, by heating the emulsified reaction liquid in the presence of an appropriate catalyst, as described hereinbefore, so as to form shells around the core material droplets. Subsequently, the encapsulated toner is separated from the aqueous reaction medium and dried to obtain a dry encapsulated toner. The encapsulated toner is preferably washed with water after the separation from the aqueous reaction medium and prior to the drying procedure. The drying procedure can be carried out by a known process such as the spray-drying process or the freeze-drying process. The spray-drying process is preferred.

The so-produced dry encapsulated toner can be admixed with an insulating material and/or a charge controller such as a metal-containing dye or Nigrosin dye.

The dry encapsulated toner can be admixed with a flow lubricant such as hydrophobic silica powder so that the flow lubricant can be dispersed over the surface of the encapsulated toner. The encapsulated toner having the flow lubricant such as hydrophobic silica powder over the toner surface shows particularly improved powder quality and property, and accordingly is very advantageous in the practical use.

The encapsulated toner obtained as above can be introduced into the electrostatographic copying and duplicating machine to develop an electrostatographically produced latent image so as to produce a visible toner image on the surface of the photoconductive material. The visible image is then fixed onto a support medium such as paper by means of an appropriate pressure fixing apparatus. There is no limitation on the pressure fixing apparatus for fixing the encapsulated toner of the invention, and any known apparatus can be applied to the fixing of the encapsulated toner of the invention. Examples of the pressure fixing apparatuses include those illustrated in Japanese Patent Publications Nos. 44(1969)-9,880, 44(1969)-12,797, and No. 46(1971)-15,876; and Japanese Patent Provisional Publications Nos. 49(1974)-62,143, 49(1974)-77,641, 50(1975)-51,333, 51(1976)-31,235, 51(1976)-40,351, 52(1977)15,335, 52(1977)-102,743, 54(1979)-28,636, . 54(1979)-32,326, 54(1979)-41,444, and No. 54(1979)-48,251.

The electrostatographic toner material comprising the encapsulated toner particles of the invention has improved powder characteristics, and is resistant to the mechanical shock and abrasion in the developing apparatus of the electrostatographic copying and duplicating machine. Further, the electrostatographic toner material of the invention is easily rupturable in the pressure fixing apparatus to produce a visible toner image well fixed onto the support medium such as paper. Furthermore, the toner material of the invention hardly undergoes off-setting to a pressing roller and hardly undergoes the so-called filming on the surfaces of the carrier particles, the developing sleeves and the photoconductive material.

In the employment for the one component developing process, the toner material of the invention is well qualified in the developing characteristics such as for producing a very clear visible image, the pressure fixing characteristics and the resistance to the off-setting. Moreover, no filming is produced on the surfaces of the development sleeve and the photosensitive material.

Other features of the electrostatographic copying and duplicating process employing an encapsulated toner material are described in U.S. Pat. No. 3,788,994, which is introduced hereinto as the reference.

The present invention will be illustrated by the following examples which are by no means intended to introduce any restriction into the invention.

EXAMPLE 1

Into a dispersion of 3 g. of carbon black and 15 g. of magnetite (EPT-1000, produced by Toda Industry Co., Ltd., Japan) in 27 g. of dibutyl phthalate was introduced 10 g. of a mixture of acetone and methylene chloride (1:3, volume ratio), and the mixture was then admixed to become homogeneous.—Primary liquid.

Subsequently, 4 g. of an adduct of hexamethylene diisocyanate with hexanetriol (3:1 molar ratio adduct) and 0.05 g. of dibutyltin laurate (catalyst) were added to the primary liquid at room temperature.—Secondary liquid.

Independently, 3 g. of gum arabic was dissolved in 57 g. of water at 20° C., and into this solution under vigorous stirring was poured little by little the secondary liquid. Thus, there was obtained an oil-in-water emulsion containing oily droplets having average diameter of 5–15μ. The procedure for the preparation of the emulsion was carried out under cooling the reaction vessel for keeping the temperature of the emulsion below 20° C.

To the emulsion was further added under stirring 100 g. of water heated to 40° C. After completion of the addition of water, the emulsion was gradually heated to 90° C. over 30 min. The emulsion was kept under stirring at the temperature for 20 min. so as to complete the encapsulating reaction.

The dispersion containing the encapsulated oily particles was subjected to centrifugal separation at 5,000 r.p.m. to separate the encapsulated particles from the aqueous gum arabic solution. The so separated encapsulated particles were again dispersed in 100 ml. of water, and the dispersion was dried in a spray-drying apparatus to obtain a powdery encapsulated toner material.

The encapsulated toner material obtained above was composed of a core containing the carbon black, magnetite and dibutyl phthalate and a shell made substantially of a reaction product of the adduct of hexamethylene diisocyanate with hexanetriol and water. Microscopic observation of the encapsulated toner indicated that most of the toner particles were present independently and that no bulky agglomerated particles were formed.

To 20 g. of the encapsulated toner obtained in the above was added 0.5 g. of a powder of stannic oxide doped with antimony (mean diameter: 0.1 microns, volume resistance: 1 ohn - cm, antimony content: 1 molar (%). The mixture was then blended well to give an electroconductive toner material containing magnetic substance.

The electroconductive toner material was employed in the one component developing process to develop a latent image produced in a conventional electrostatographic process through magnetic brush development so as to produce a visible image. The visible toner image was then converted onto a paper.

The paper carrying the toner image was treated under a pressing roller at a pressure of 350 kg./cm$^2$.

There was obtained a toner image with high sharpness and well fixed onto the paper. Further, the off-setting of the toner was at a very low level.

EXAMPLE 2

In 50 g. of hot water at approximately 80° C. was dissolved 2.5 g. of polyvinylbenzenesulfonic acid partly in the form of sodium salt (VERSA TL-500, trade name of National Starch Corporation: mean molecular weight 500,000) under stirring. The solution was cooled, and aqueous sodium hydroxide (20% by weight aqueous solution) was added to the cooled solution to adjust the pH to 4.0.

Into the so produced aqueous solution was poured a primary solution prepared in the same manner as described in Example 1, so as to obtain an oil-in-water emulsion containing oily droplets having average diameter of 5–25μ.

Independently, 3 g. of melamine, 5 g. of aqueous formaldehyde (37% by weight solution) and 40 g. of water were stirred at 60° C. to produce a clear solution containing melamine, formaldehyde and a precondensate of melamine and formaldehyde.

The clear solution was then added to the emulsion, and the mixture was adjusted to pH 6.0 with aqueous acetic acid (20% by weight). The aqueous mixture was subsequently heated to 65° C. and kept at the temperature for 60 minutes under stirring. Thereafter, the aqueous mixture was adjusted to pH 4.0 with 1-N hydrochloric acid, and to the mixture was added 15 g. of aqueous urea (40% by weight solution). The aqueous mixture was further stirred at 65° C. for 40 minutes, and again adjusted to pH 9.0 with aqueous sodium hydroxide (20% by weight solution), completing the encapsulating reaction.

The dispersion containing the encapsulated particles was subjected to centrifugal separation at 5,000 r.p.m. to separate the encapsulated particles from the aqueous polyvinylbenzenesulfonate solution. To the so separated encapsulated particles were added 100 cc. of water and 20 g. of a dispersion containing 10% by weight of a powder of stannic oxide doped with antimony (mean diameter: 0.1 micron, volume resistance: 1 ohn - cm, antimony content: 1 molar %). The so obtained suspension was spray-dried to give an electroconductive toner material containing magnetic substance. The shell of the toner material was composed of a melamine-urea-formaldehyde resin.

The electroconductive toner material was employed in the one component developing process to develop a latent image produced in a conventional electrostatographic process through magnetic brush development so as to produce a visible image. The visible toner image was then converted onto a paper.

The paper carrying the toner image was treated under a pressing roller at a pressure of 350 kg./cm$^2$.

There was obtained a toner image with high sharpness and well fixed onto the paper. Further, the off-setting of the toner was at a very low level.

I claim:

1. An electrostatographic toner material comprising encapsulated toner particles having an average particle size in the range from about 0.5 to about 1,000 microns, in which the toner particle comprises a pressure fixable adhesive core material containing colorant and magnetizable substance and a pressure rupturable shell enclosing the core material, the outer surface of the shell being provided with a white powder of electroconductive stannic oxide selected from the group consisting of $SnO_2$ doped with 0.01–30 molar % of a donner atom selected from the group consisting of antimony, niobium, and halogen, and a combination of $SnO_2$ and one or more electroconductive metal oxides selected from the group consisting of oxides of zinc, titanium, aluminum, indium, silicon, magnesium, barium and molybdenum.

2. The electrostatographic toner material as claimed in claim 1 in which said powder of stannic oxide has a volume resistance not higher than $10^7$ ohm-cm, the value being measured in the form of powder.

3. The electrostatographic toner material as claimed in claim 2 in which said volume resistance is not higher than $10^3$ ohm-cm.

4. The electrostatographic toner material as claimed in claim 1, in which the shell is made of a polymer selected from the group consisting of polyurethane, polyurea and an amino resin.

5. The electrostatographic toner material as claimed in claim 4, in which the shell is made substantially of a polycondensation product of polyisocyanate, polyol and water.

6. The electrostatographic toner material as claimed in claim 4, in which the shell is made substantially of a polycondensation product of polyisocyanate, polyol and polyamine.

7. The electrostatographic toner material as claimed in claim 1, in which the shell is composed substantially of a complex layer comprising two or more polymers selected from the group consisting of polyurethane, polyurea and polyamide.

8. The electrostatographic toner material as claimed in claim 1, in which the pressure fixable adhesive core material is a liquid medium boiling at a temperature of higher than 180° C.

9. The electrostatographic toner material as claimed in claim 1, in which a flow lubricant is provided onto the surface of the shell.

* * * * *